US005252092A

United States Patent [19]

Reider et al.

[11] Patent Number: 5,252,092

[45] Date of Patent: Oct. 12, 1993

[54] ELECTRICAL CONNECTOR ASSEMBLY

[75] Inventors: Christopher G. Reider, Youngstown; William G. Strang, Warren, both of Ohio

[73] Assignee: General Motors Corporation, Detroit, Mich.

[21] Appl. No.: 1,962

[22] Filed: Jan. 8, 1993

[51] Int. Cl.[5] ..... H01R 13/40

[52] U.S. Cl. ..... 439/595; 439/598

[58] Field of Search ..... 439/352, 357, 594–599, 439/752

[56] References Cited

U.S. PATENT DOCUMENTS 4,963,103 10/1990 Fink et al. ..... 439/352

5,181,862 1/1993 Hawk et al. ..... 439/598

*Primary Examiner*—Paula A. Bradley

*Attorney, Agent, or Firm*—William A. Schuetz

[57] ABSTRACT

An electrical connector assembly has a multiple cavity thermoplastic connector body for receiving cylindrical terminals. The connector body has cantilevered deflectable arms provided with underlocks which overlie open channels provided with aligned lock ramps. The terminals, when being connected to the connector body, engage the ramps and cause the arms to be deflected from their normal position until lands on the terminal move past the lock ramps and underlocks on the arms whereupon the arms snap back to their normal position and provide an audible click to apprise an assembler that the terminal has been properly connected.

3 Claims, 7 Drawing Sheets

ELECTRICAL CONNECTOR ASSEMBLY

The present invention relates to electrical connectors and, more particularly, to an electrical connector assembly having multiple terminals and a multiple cavity thermoplastic connector body provided with deflectable fingers which provide audible clicks to indicate when the terminals are properly assembled thereto and which, when in a deflected position, engage a terminal position assurance end cap to prevent assembly of the end cap until all of the terminals are properly connected to the connector body.

BACKGROUND OF THE INVENTION

U.S. Pat. No. 4,963,103, which is assigned to the same assignee as the present invention, shows in FIGS. 1-3 an electrical connector assembly 10 having a thermoplastic connector body 12, a plurality of electrical terminals 14 which are attached to a plurality of insulated conductor wires 16, an elastomeric seal 18, a thermoplastic back shell 20 to which the connector body and elastomeric seal are connected, a connector position assurance device 22 and a thermoplastic end cap 24. The elastomeric seal 18 provides both a conductor wire and interface seals with the back shell 20. The back shell 20 included an end bell defined by movable clam shells 74, 76 which gathered the conductor wires 16 in a bundle when in a closed position.

The connector body 12 had a plurality of terminal cavities 26 which extended axially through the connector body 12 from a forward contact end 28 to a rearward conductor end 30. The connector body 12 had a nose portion of reduced height at the contact end 28, an enlarged rearward portion 34 at the conductor end 30 and lock posts 38 for connection to the back shell 20. The nose portion 32 comprised a plurality of ribs defining side by side channels 40 at the forward portion of the terminal cavities 26. Each terminal cavity 26 had a catch 42 at the forward end of the channel 40 to hold the terminal 14 down in the channel 40 and a wedge shaped lock shoulder 44 near the rearward end of its channel 40 for retaining the terminal 14 in the terminal cavity 2 and preventing it from being pulled rearward out the rearward conductor end 30.

Each of the terminals 14 disposed in the respective cavities 26 had a tubular receptacle at its forward end 46, axially spaced lands defining a circumferential groove 48 intermediate its ends and conventional crimp wings 50 at its rear end for attaching the terminal 14 to the associated insulated conductor wire 16.

In the above noted electrical connector assembly 10, the terminals 14 crimped to the individual electrical conductors 16 were inserted through aligned openings in the back shell 20, seal 18 and the cavities 26 of the connector body 12 from the rearward conductor end 30 towards the forward contact end 28. The terminals 14 were received within the channels 40 and with the forward land defining in part the recess 48 of each terminal 14 being ramped over its associated shoulder 44 to lock the terminal 14 in place. When this occurred, the forward end of the terminal contacts 46 were received within the catches 42 to hold the terminal 14 in place.

A drawback in the above-noted electrical connector assembly 10 was that it was somewhat difficult to retain or maintain the already connected terminals 14 in place as each individual additional terminal and conductor wire 16 was being connected to the connector body 12.

If the terminal 14 and the electrical conductor 16 were accidentally moved in compression or toward the left, was possible for the terminal 14 to pop out of the catch 42 and out of the channel 40. Likewise, if the terminal 14 was not fully inserted so that it locked past the lock shoulder 44, the terminal 14 was not properly positioned. Thereafter, when the end cap 24 was placed over the terminals 14 and the forward portion of the connector body 12, the end cap 24 could be connected even though not all the terminals were properly positioned or locked in place. Thus, the assembler had to be very careful during assembly of the individual terminals 14 to make certain all were properly connected or positioned prior to applying the end cap 24.

FIGS. 9 and 10 of the drawings of the present application also shows a previously used connector body 12A like the connector body 12 shown in the prior patent, U.S. Pat. No. 4,963,103, but wherein the catches 42 shown in the connector body 12 of the patent were eliminated and instead an integrally formed deflectable single flapper A overlying portions of all of the channels 40A was provided to hold the terminals 14A down into the channels 40A. The parts shown in FIGS. 9 and 10 which correspond to the parts shown in the aforementioned patent will be given the same reference numerals, but with a suffix A added to the numerals. The flapper A at its rearward end was formed integral with the rearward end 30A of the connector body 12A and had a forward end B which overlay the individual channels 40A. The flapper A extended laterally across all of the channels 40A of each row of channels and comprised a plurality of transversely spaced slats C extending forwardly from the rearward end 30A and which terminated in a transversely extending strip E at the forward end B which overlay all of the channels 40. The slats are separated by slots D extending from the strip E to the rearward end 30A in order to render the flapper A more flexible. In this embodiment, the flapper A was supported in cantilever fashion and had a smooth or continuous undersurface F, as shown in FIG. 10, which overlaid all of the terminals 14A in each row of channels 40A to retain them down in the channels 40A. The function of the flapper A was to deflect away from the channels 40A when the terminals 14A were being inserted and engaged the shoulders 44A and then move and retain the terminals 14A in place behind the shoulders 44A during the harness build, i.e., inserting all of the terminals 14A and conductors 16A in the electrical conductor body, until an end cap 24A (like the end cap 24 of the aforementioned patent) is placed on the forward end 28A of the connector body 12A and with the end cap 24A overlying the forward portion B of the flapper A.

It was found, however, that the single flapper A does not retain the terminal 14A in place if the lead 16A is tensioned, i.e., the lead 16A is pulled to the left, as viewed in FIGS. 9 and 10, with sufficient force. That is, the flapper A deflects away from the channel 40A to allow the terminal 14A to be cammed out of its locking engagement with the shoulder 44A, if a sufficient pull force to the left is exerted. Also, if the terminal 14A is unseated by not being locked over the locking shoulder 44A in the channel 40A, but is located on the ramp of the shoulder 44A, as shown by the dotted lines in FIG. 10, the flapper A is raised up and the terminal next to it will have no retention during harness build prior to connection of the end cap 24A. Likewise, the flapper design A does not provide any audible noise that provides feedback to an assembly operator that the terminal is properly seated when connected to the connector body 12A. In addition, the flapper design A would allow the end cap 24A to be placed on the connector 12A even if a terminal 14A is not properly seated by being locked over the shoulder 44A in the channel 40A of the connector body 12A.

SUMMARY OF THE PRESENT INVENTION

The present invention provides an electrical connector assembly similar to the above-noted types, but which provides an improved connector body for retaining the electrical terminals in place. The new connector body eliminates the prior catches, like catch 42 of U.S. Pat. No. 4,963,103 and eliminates the one piece flapper A as shown in FIGS. 9 and 10.

In accordance with the provisions of the present invention, individual, cantilevered flexible arms or fingers with an underlock overly each of the respective channels at the forward end of the connector body for receiving the terminals. The arms are integral with the rearward portion of the connector body and are independent of the adjacent arms for the adjacent channels. The flexible arms have their underlocks radially opposite the lock shoulders on the forward portion of the connector body so that the lands on the cylindrical terminals cause the arms to be deflected radially outwardly of their normal free state position until the forward land of the terminal moves therepast whereupon the arms, due to their self-biasing forces, snap lock behind the land and do so with an audible click. This click provides feedback to the assembly operator to assure the assembler that the terminal has been properly connected to the connector body. The lead can then be pulled back with the land engaging the shoulders on the underlock of the arm and the ramp in the channel on the connector body.

Another advantage of the present invention is that if any of the terminals are not properly seated within the channels, the forward end of the terminals will be in engagement with the ramps of the underlock on the arms and the ramp in the channels, which in turn causes the arms to be unseated or raised. If the arms are not all in their normal free state position, the terminal position assurance end cap, when being connected to or seated on the forward end of the connector body, will hit the arm so that it cannot be seated to the connector body. This alerts the assembler that there is an unseated terminal and enables the assembler to properly seat that terminal prior to the end cap being fully connected. Moreover, if the end cap were to be forced against the arm while the arm is unseated, the flexible arm will snap outside of the end cap and thus provide a visual indication that there is an unseated terminal.

In addition, it has been found that with the use of the flexible arms for the electrical connector body, that the pull out force required for unseating a terminal by pulling it out rearwardly of its rearward end is considerably greater than the pull out force required to unseat a terminal when using the connector body having the flapper A described above.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
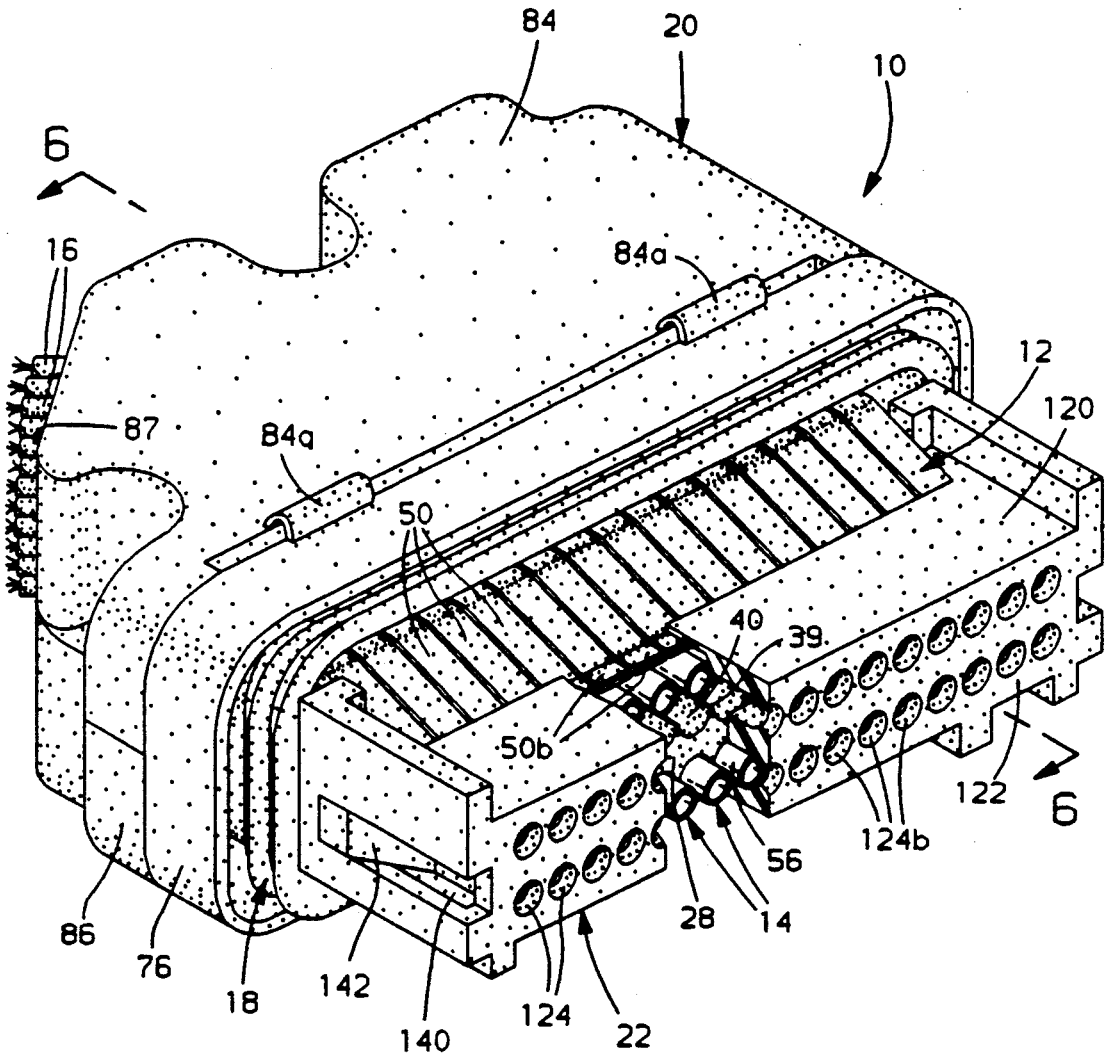
FIG. 1 is a top side perspective view, with portions broken away, of the novel electrical connector assembly of the present invention.

Referring to FIGS. 1—8 of the drawings, an electrical connector assembly 10 made in accordance with the present invention is thereshown. The connector assembly 10 is adapted to be plugged into a mating socket or header connector (not shown) like the connector 11 shown and disclosed in the aforementioned U.S. Pat. No. 4,963,103.

The electrical connector assembly 10 comprises, in general, a thermoplastic connector body 12, a plurality of electrical terminals 14 which are attached to a plurality of insulated conductor wires 16, an elastomeric seal 18, a thermoplastic back shell 20, a thermoplastic end cap 22 and a lock arm or device 24.

Figure 3:
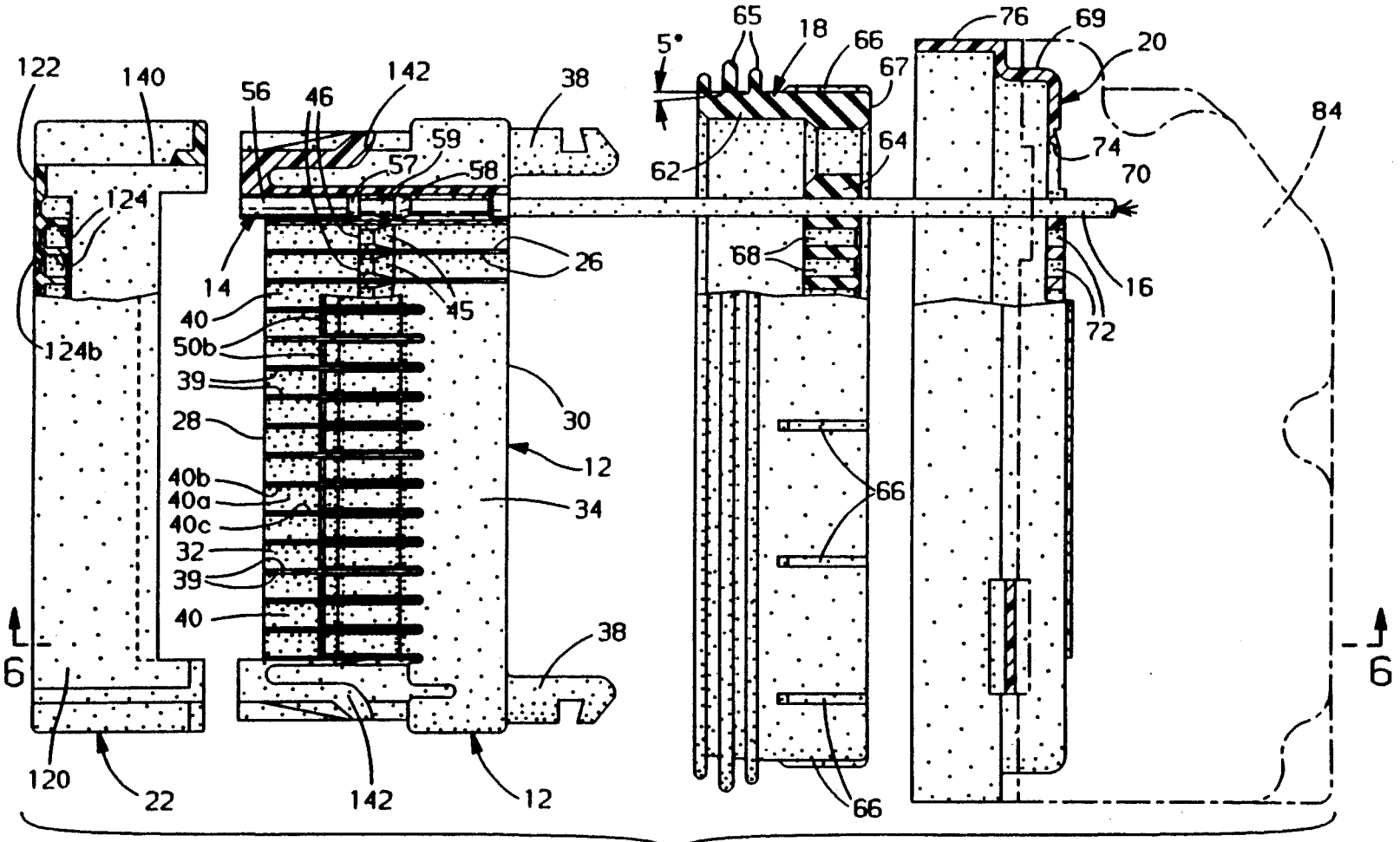
FIG. 3 is an exploded bottom plan view, with portions shown in section, of the electrical connector assembly of the present invention.
Figure 6:
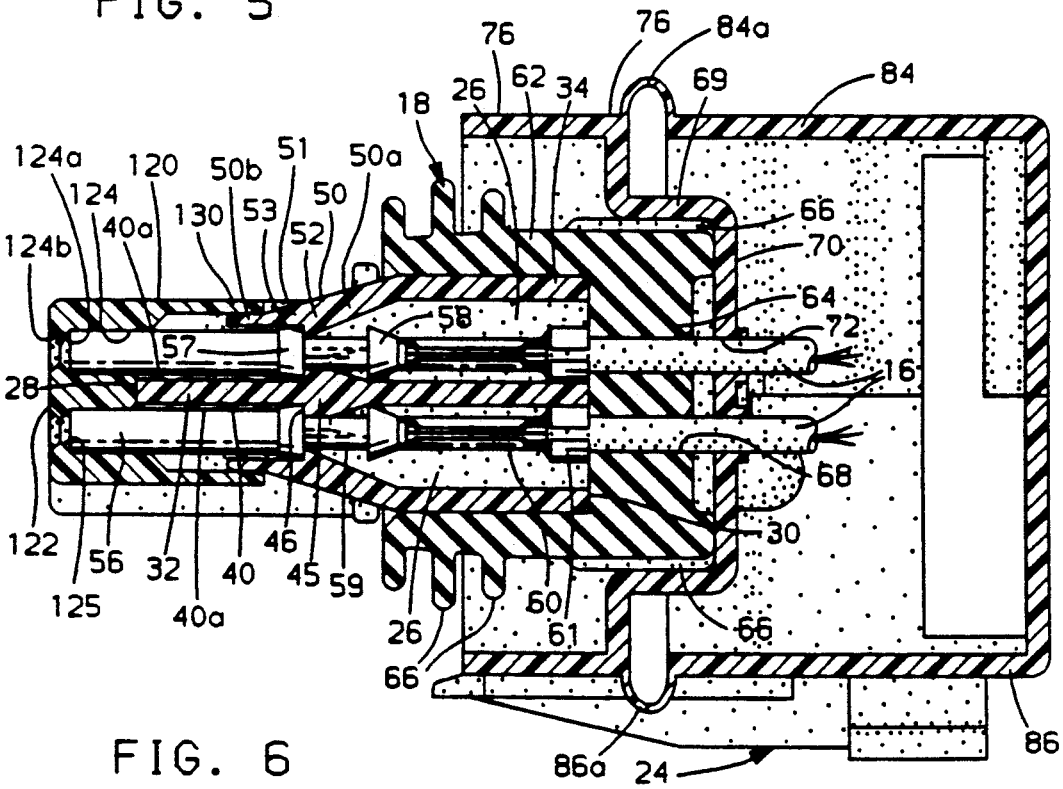
FIG. 6 is an enlarged fragmentary cross sectional view taken approximately along lines 5—5 of FIG. 1.
Figure 7:
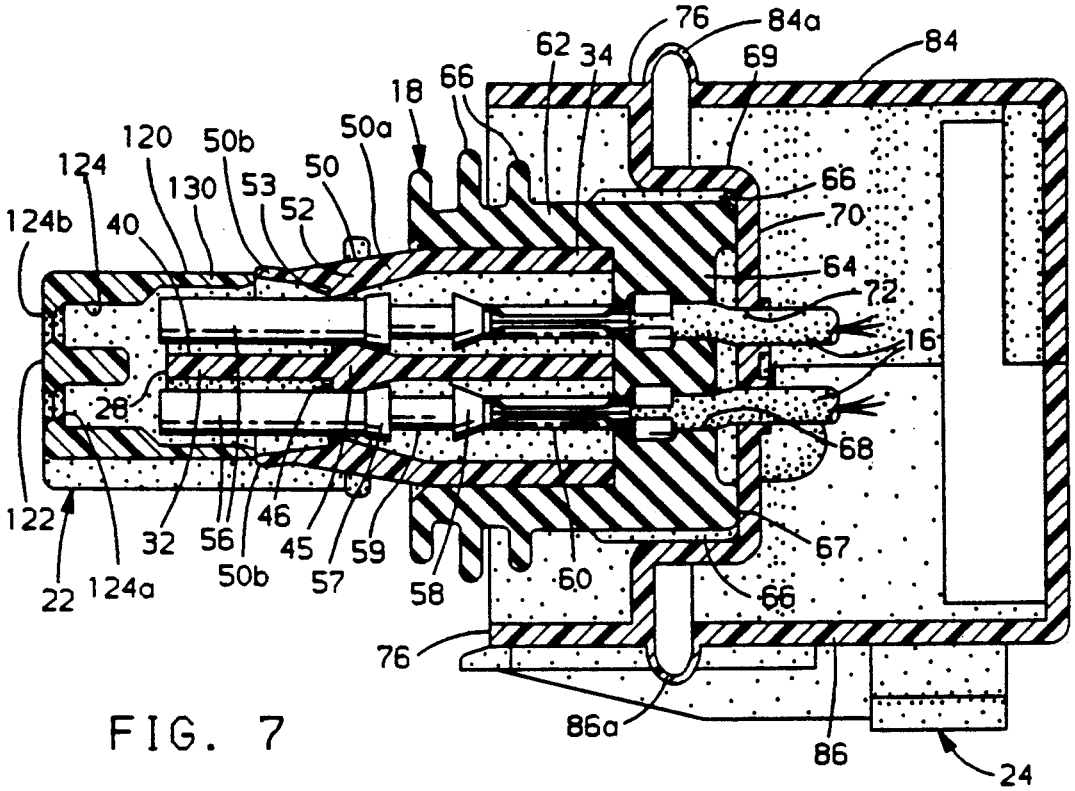
FIG. 7 is an enlarged fragmentary sectional view of part of the electrical connector assembly shown in FIG. 6, but showing different parts in different positions.

The connector body 12 has a plurality of terminal cavities 26 which extend axially through the connector body 12 from a forward contact end 28 to a rearward conductor end 30. The cavities 26 are located side by side and form two rows: an upper row and a lower row, as best shown in FIGS. 3, 6 and 7. The connector body 12 has a nose or forward portion 32 of reduced height which terminates at the contact end 28 and an enlarged rearward portion 34 at the conductor end 30 and has axially extending lock posts 38 which project axially from the rearward conductor end 30 of the enlarged rearward portion 34.

Figure 5:
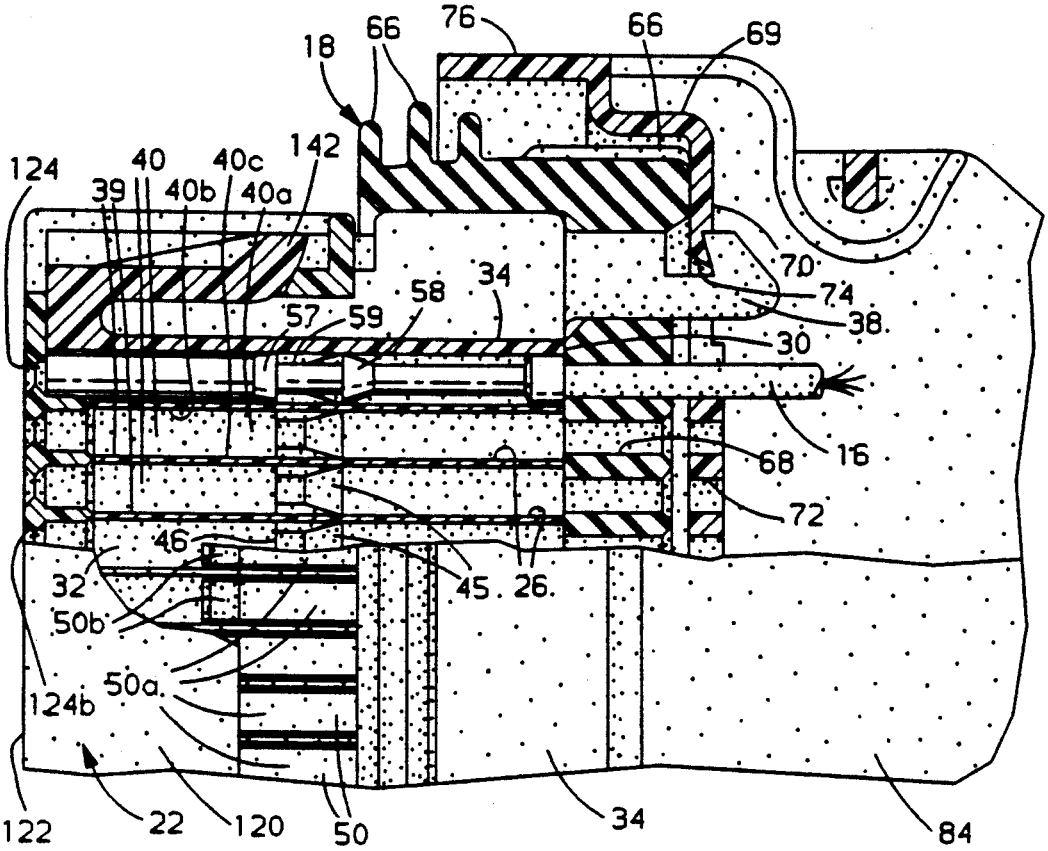
FIG. 5 is an enlarged fragmentary top elevational view, with portions shown in cross section, of part of the electrical connector assembly of FIG. 1.

The terminal cavities 26 along the rearward portion 34 of the connector body 12 are of a generally oval cross section and elongated in the vertical direction, as shown in FIG. 6. The nose portion 32 comprises a plurality of transversely spaced, upwardly and downwardly facing ribs 39 which define side by side channels 40. The channels 40 each comprise a forward portion of a terminal cavity 26. As best shown in FIGS. 1, 3 and 5, the channels 40 are generally U-shaped and defined by an inner wall section 40*a* and side wall sections 40*b* and 40*c* and an open outer side or wall. Integral with the inner and side walls 40*a*, 40*b* and 40*c* and extending radially inwardly of the channels 40 are tapered ramps 45 which terminate in radially extending shoulders 46 for retaining the terminals in the channels 40. The ramps 45 and shoulders 46 are located in the channels 40 intermediate the axial ends of the nose portion 32.

In accordance with a major provision of the present invention, the connector body 12 is provided with a plurality of individual, deflectable, cantilevered arms 50. The arms 50 are integral with the rearward portion 34 of the connector body 12 and each overlies one of the channels 40. The arms 50, in effect, form outer walls for an axially extending portion of the channels 40. The arms 50 each have a rearward portion 50*a* which tapers toward the inner wall 40*a* of the channel 40 and a free end portion 50*b* which extends parallel to the channel 40. The arms 50 are also provided with underlocks 51 defined by inwardly extending ramps 52 which terminate in a radially extending shoulder 53. The ramps 52 are located directly opposite the ramps 45 and the shoulders 53 lie in the same plane as the shoulder 46 of the ramp 45, which plane is normal to the longitudinal axis of the connector body 12.

The arms 50 have a normal free state position, as shown in FIG. 6, but can be deflected outwardly away from the channel 40 to deflected positions, as shown, for example, in FIG. 6. The arms 50 are deflected from their normal position to an outer position by the terminals 14 when the latter are inserted in the cavities 26 until the terminals lock behind the shoulders 53 and 46. The arms 50 when deflected will snap return to their normal free state position and provide an audible click to apprise the operator that the terminals 14 have been properly seated, and in a manner to be hereinafter more fully described.

One of the terminals 14 is disposed in each terminal cavity 26. The terminals 14 are socket type terminals of a conventional and well known construction. Alternately they could be pin terminals. Suffice it to say that each of the metal terminals 14 has a tubular receptacle or cylinder 56 at its forward end, a pair of spaced lands 57, 58 intermediate its opposite ends which define a radially extending groove 59 therebetween and conventional crimp wings 60, 61 which are crimped onto the bare conductor and the insulated conductor sheath respectively.

The elastomeric seal 18, which is preferably made of a silicone rubber, is seated over the rearward portion 34 of the conductor end 30 of the connector body 12. The elastomeric seal 18 comprises an annular wall 62 and a back wall 64. The annular wall 62, which fits snugly on the rearward portion 34 of the connector body 12, has a forward portion which has a taper of about 5° (see FIG. 3). This forward portion has a plurality of circumferentially extending axially spaced sealing lips 65 which are in a modified tapered pattern. The modified tapered pattern of the sealing lips 65 is such that the tips of the end lips lie in an imaginary line or surface which also has a taper of about 5° while the tip of the middle lip lies outwardly thereof when the sealing lips are in their free undeflected state, as shown in FIGS. 3 and 5. Thus the forward sealing lip 65 has the smallest outside diameter while the middle sealing lip has the largest outside diameter and the rear sealing lip 65 has a larger diameter than the forward sealing lip 65. The sealing lips 65 are adapted to provide an interface seal when the connector body is plugged into a mating connector body (not shown) and the sealing lips are deflected.

Figure 4:
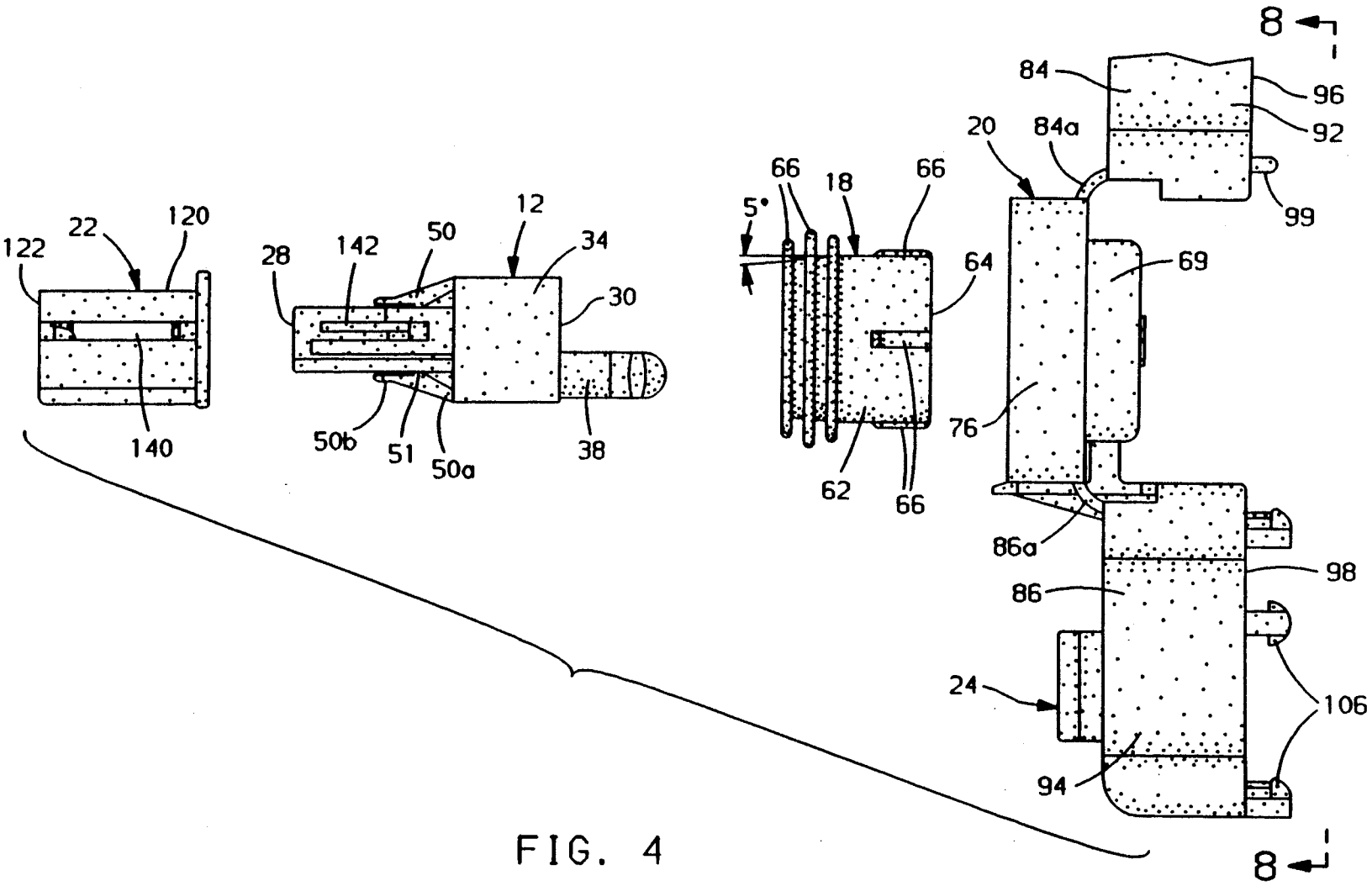
FIG. 4 is an exploded side plan view of the electrical connector assembly of the present invention.

The rearward portion of the annular wall 62 has a plurality of peripherally spaced but longitudinally extending ribs 66 at the rearward or right end of the elastomeric seal 18, as best shown in FIGS. 3–5. The function of the longitudinal rib 66 is to stabilize the connection of the connector body 12, the elastomeric seal 18 and the back shell 20 in the transverse or radial direction.

The back wall 64 of the elastomeric seal 18 has a circumferentially extending rib or projection 67 at its outer margin and a plurality of apertures 68 which are disposed inwardly of the circumferential rib 67. The function of the circumferential rib 67 is to stabilize the connection of the connector body 12, the elastomeric seal and the back shell 20 in the longitudinal direction. The plurality of apertures 68 extend through the back wall 64 and are aligned with the terminal cavities 26 and the lock posts 38. The apertures 68 are sized so that the back wall 64 seals around the insulated conductor wires 16 and the lock posts 38 which project through the apertures 68 when the elastomeric seal 18 is mounted on the connector body 12 and the terminals 14 are inserted into the terminal cavities 26. Thus, the elastomeric seal 18 also seals the conductor end 30 of the connector body 12, as shown in FIG. 5.

The back shell 20 is fitted over the elastomeric seal 18 and attached to the rearward conductor end 30 of the connector body 12 via the lock posts 38 in order to retain the elastomeric seal 18 in place. The back shell 20 has an annular wall 69 which engages the longitudinal ribs 66 of the elastomeric seal 18 and a back wall 70 which engages the circumferential rib 67 of the elastomeric seal 18 so as to bias the elastomeric seal snugly into engagement with the rear portion 34 and conductor end face 30 of the connector body 12. This stabilizes the connection between these three parts in the transverse or radial and longitudinal direction as indicated above.

The back wall 70 of the back shell 20 has a plurality of guide holes 72 which are aligned with the apertures 68 of the elastomeric seal 18 and the terminal cavities 26 of the connector body 12. The guide holes 72 are used to guide the terminals 14 into the terminal cavities 26 through the apertures 68 of the elastomeric seal 18. The guide holes 72 are larger than the terminals 14 so that the terminals 14 can be freely inserted through the guide holes 72.

Figure 8:
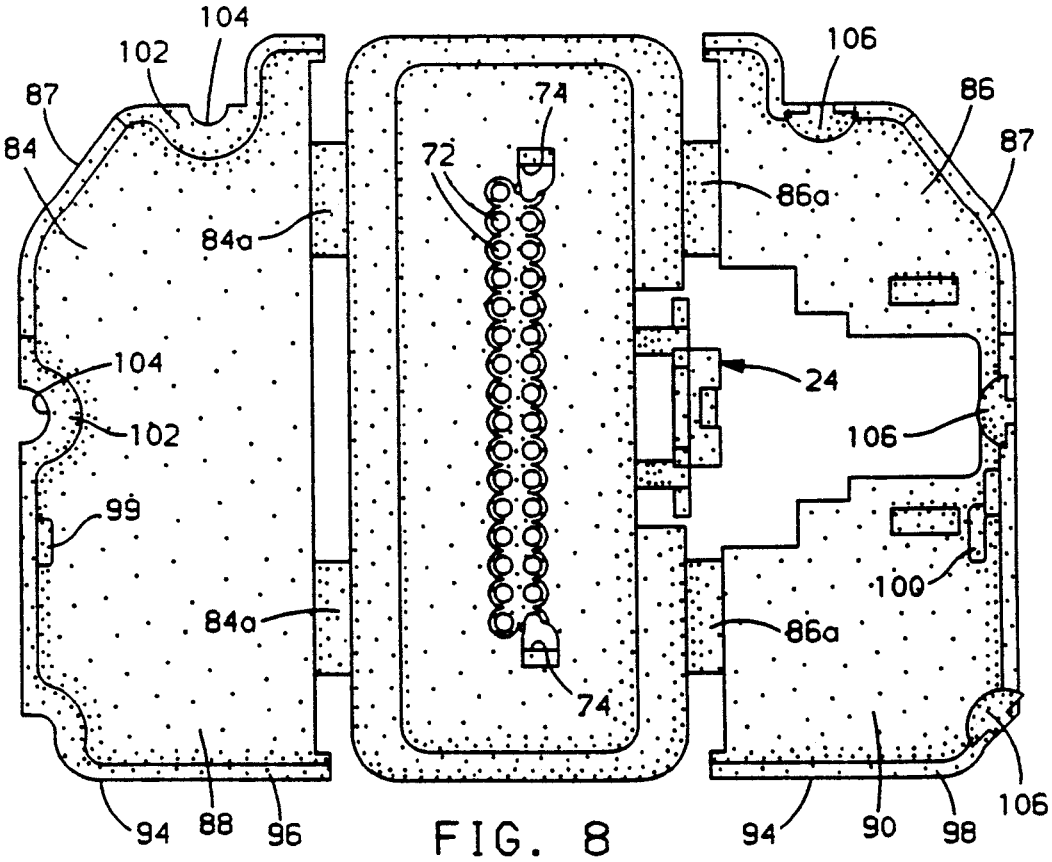
FIG. 8 is a view of part of the electrical connector assembly shown in FIG. 4 and looking in the direction of the arrows 8—8 of FIG. 4.
Figure 9:
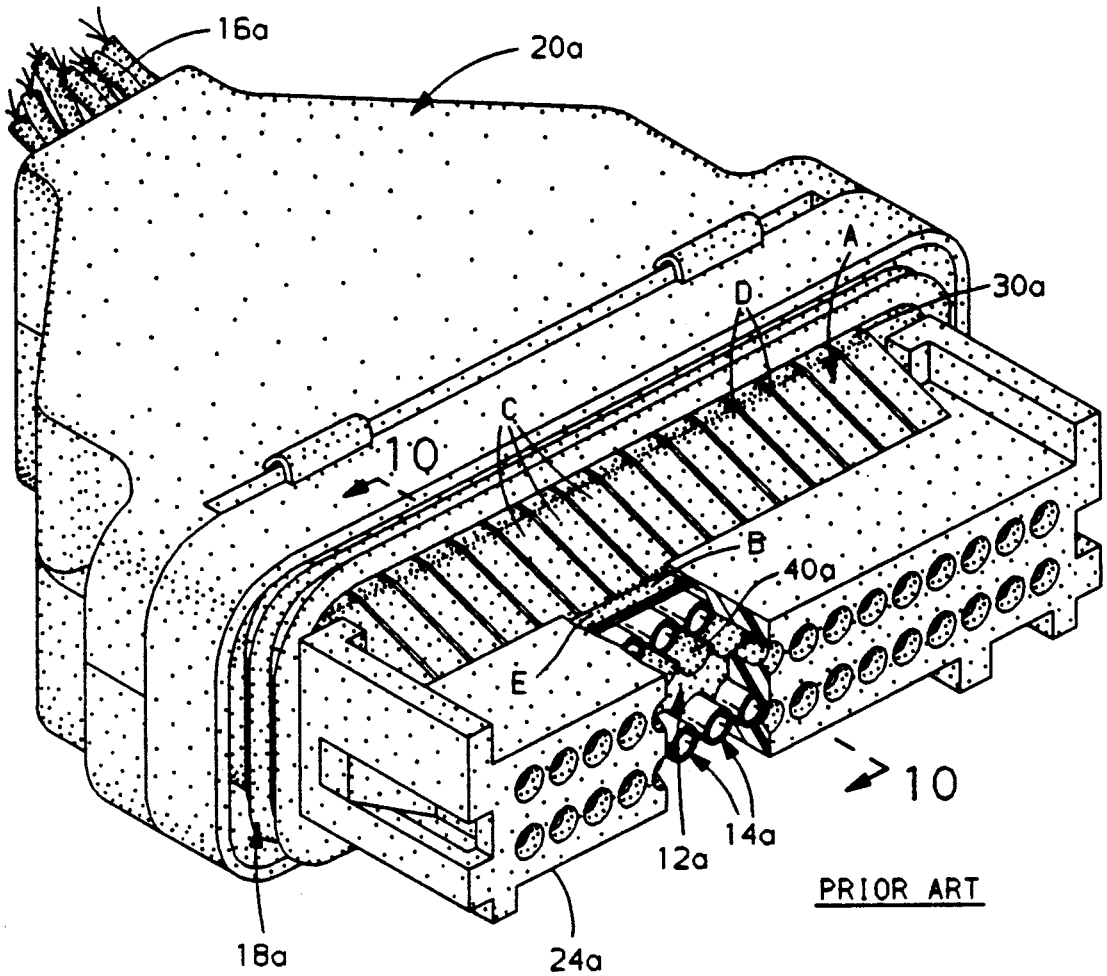
FIG. 9 is a perspective view of a previously used prior art connector body having a flapper.
Figure 10:
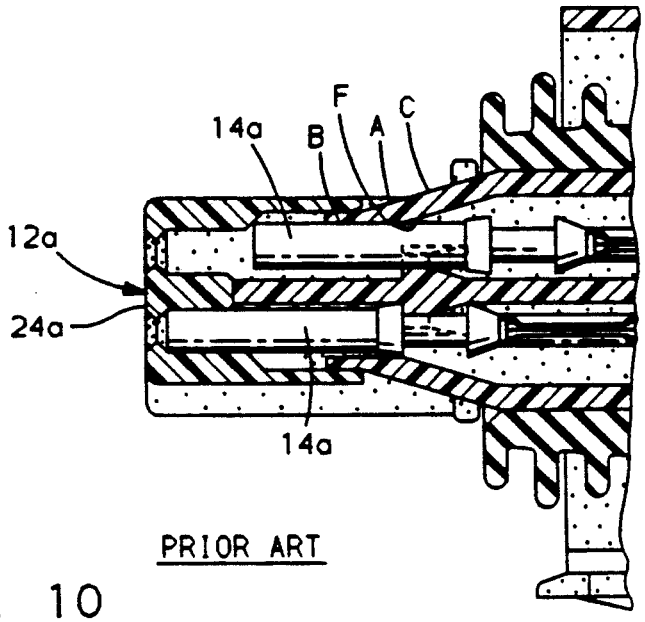
FIG. 10 is an enlarged fragmentary sectional view taken approximately along the lines 10—10 of FIG. 9.

The back wall 70 of the back shell 20 also has two latch holes 74 which receive and cooperate with the lock posts 38 to secure the back shell to the connector body 12 (see FIG. 5). The latch holes 74 are merged with two of the guide holes 72, as shown in FIGS. 5 and 8.

The back shell 20 also has a forward enlarged shroud 76 which is spaced radially outwardly of the annular wall 69 and of the circumferential sealing lips 65 of the elastomeric seal. It also extends forwardly of the elastomeric seal 18 to protect the elastomeric seal 18 during handling, as shown in FIGS. 5 and 6.

The back shell 20 further includes the lock device 24 in the form of a pump handle lock arm which is attached to the annular wall 69 of the back shell 20 by integral hinges 79 to form a forward lock arm 78 and a rearward release handle 82. The lock arm 78 has transverse catches 80 which are forward of the hinges 79 and the rearward release handle 82 pivots the forward lock arm 78 and the catch 80 outwardly about the integral hinges 79 when the rearward release handle 82 is depressed.

The back shell 20 further includes an end bell 83 for gathering the insulated conductors 16 into a bundle and which comprises upper and lower clam shells 84, 86 which are integrally hinged to the back shell 20 via hinges 84a, 86a. The clam shells 84, 86 move between an open position providing access to the back wall 70 of the back shell 20 which is shown in FIGS. 4 and 8 and a closed position shown in FIGS. 1, 2 and 5–7. In a closed position, the ends of the clam shells 84, 86 cooperatively provide a side opening 87 through which conductor wires 16 extend, as hereinafter more fully described.

The upper and lower clam shells 84, 86 have planar walls 88, 90 which are integrally hinged to the back wall of the back shell shroud 76 via the hinges 84a, 86a and generally perpendicular side walls 92, 94 which are integral with the outer edges of the respective planar walls 88, 90. The planar walls, 88, 90 are parallel to each other and the generally perpendicular side walls 92, 94 have planar mating faces 96, 98 which abut each other when the upper and lower clam shells 84, 86 are in the closed position, which is shown in FIGS. 1, 2 and 5–7. The inner end of the side wall 92 has a guide tab 99 which is received in a guide 100 on the side wall 94 to guide the side walls 92, 94 to their closed position so that the faces 96, 98 engage each other to prevent the clam shells 84, 86 from pivoting past their closed position.

Figure 2:
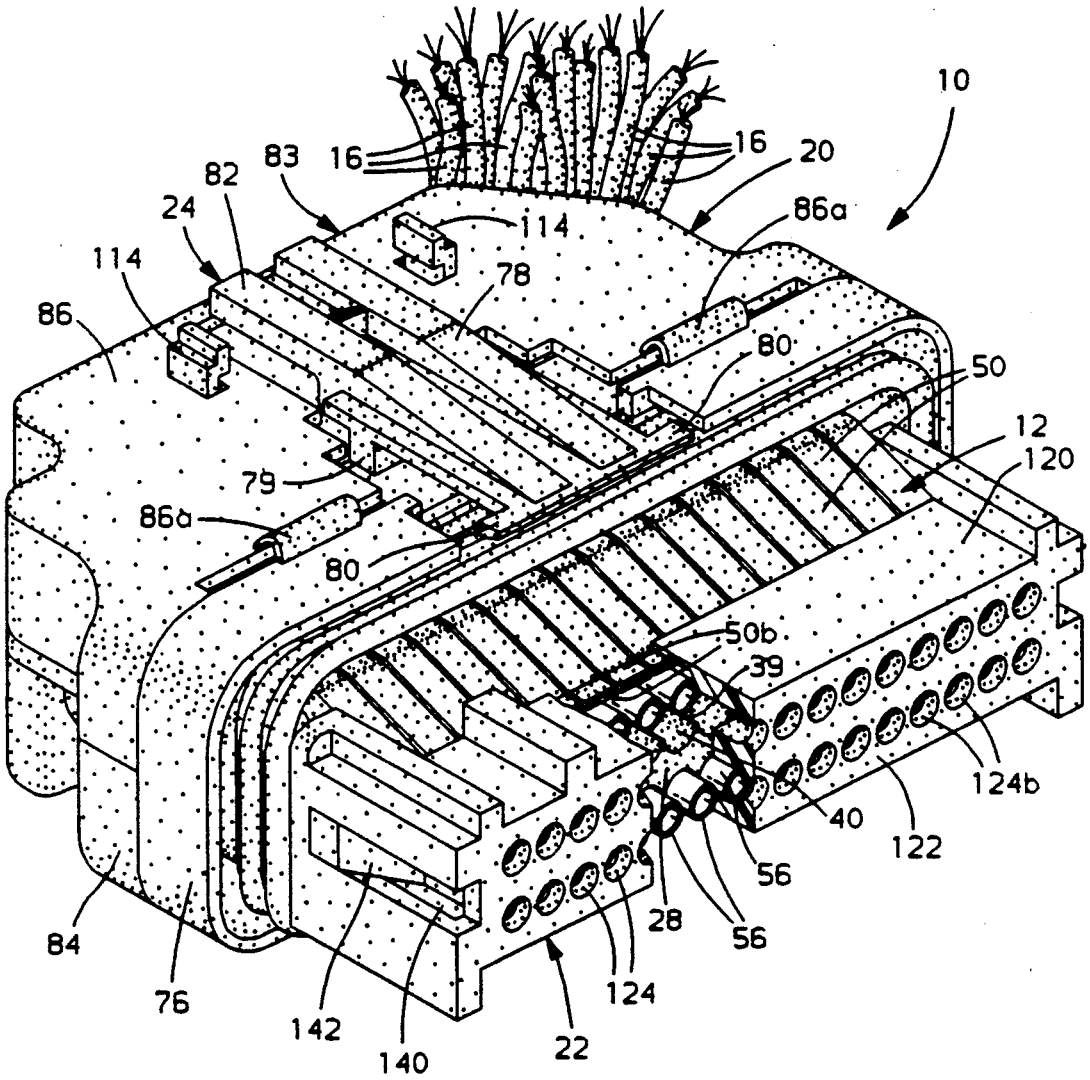
FIG. 2 is a bottom side perspective view, with portions broken away, of the novel electrical connector assembly of the present invention.

It should be noted that the conductor wires 16 are bent and then routed through the aligned openings 87 in the side walls 92, 94 of the clam shells 84, 86 of the end bell 83. The conductor wires 16 are bent so as to extend transversely of the longitudinal axis of the electrical connector 10 and then are routed through the transverse side opening 87 defined by the clam shells 84, 86, as best shown in FIGS. 1 and 2. By so routing the conductor wires 16, a good measure of strain relief is provided, since if the conductor bundle or assembly would be placed in tension or pulled, the side exit would tend to provide strain relief and prevent the individual terminals 14 from being pulled out of the electrical connector 12.

The upper and lower clam shells 84, 86 are adapted to be snap fittingly connected together in their closed position. The manner in which the clam shells are snap fittingly connected together is identical or substantially identical to that previously disclosed and described in detail in U.S. Pat. No. 4,963,103 which is hereby incorporated in this application by reference. Thus, the details in which the clam shells 84, 86 are snap fittingly connected together will not be described in detail, since resort may be had to the aforementioned patent for such details. Suffice it to say, that the upper clam shell 86 has a plurality of ledges 102 which are inward of its side wall 94, as shown in FIG. 8. These ledges are near the mating face 96 of the side wall 92 and have slots 104 which open away from the side wall 92. The lower clam shell 84 has a plurality of cooperating headed lock pins 106 integral with the side wall 94 and which extend beyond the mating face 98 of the side wall 94, as shown in FIGS. 4 and 8. When the clam shells 84, 86 are moved to be connected together, the lock pins 106 will engage the ledges 102 and be snap fitted therepast to hold the two clam shells 84, 86 in their closed position, as shown in FIGS. 1 and 2.

The clam shell 84 has laterally spaced rails 114 for receiving a connector position assurance device (not shown) when the shells 84, 86 are in their closed position and the lock arms 78 is correctly positioned to lock the electrical connector 10 to its mating electrical connector (not shown). The mating connector (not shown) would have a forward shroud which would be received within the shroud 76, engage and deflect the sealing lips 65 and have latches for snap fittingly engaging the catches 80 on the lock arm 78. The connector assurance device would be of a substantially identical construction to the connector position assurance device of the prior mentioned U.S. Pat. No. 4,963,103 and therefore, will not be shown or described herein, since it does not comprise a part of the present invention. Resort may be had to this prior patent for a complete description of the connector position assurance device.

The end cap 22 slides over the forward end 32 of the connector body 12 and serves to retain the terminals 14 in place on the connector body 12 and prevent the same from being moved forwardly or toward the left, as viewed in FIG. 6. The end cap 22 is U-shaped in cross section to define an annular or peripherally extending wall 120 and a forward end wall 122. The forward end wall 122 has a plurality of apertures 124 therethrough which are aligned with the channels 40 at the forward portion 32 of the connector body 12. The apertures 124 slidably receive the cylindrical forward ends 46 of the terminals 14. The forward end wall 122 defining the apertures 124 includes a tapered lesser diameter opening portions 124a to provide radial abutments 125 against which the forward ends of the terminals 14 can abut. Each abutment 125 is also defined by a tapered entry end opening 124b through which a mating pin terminal (not shown) of a mating electrical connector (not shown) is slidably guided into the cylindrical end 46 of the socket terminals 14.

As best shown in FIGS. 6 and 7, the end cap 22 also on its peripherally extending wall 120 has a reduced thickness portion 130 at its rearward end which slidably receives the forward portions 50b of the flexible arms 50 of the connector body 12. As best shown in FIGS. 1–4, the sides of the end cap 22 include slots 140 and the connector body 12 includes flexible side latch arms or fingers 142. The end cap 24 when positioned over the forward end 32 of the connector body 12, engages the flexible arms 142 to cause the same to be deflected toward each other until the end cap 24 passes by the arms 142 whereupon the arms return to their normal free state position by moving into the slots 140 to latch the end cap in place.

The electrical connector assembly 10 is assembled in the following manner. The elastomeric seal 18 is fitted over the rear conductor end portion 34 of the connector body 12, as shown in FIGS. 5 and 6. The elastomeric seal 18 provides both a conductor seal and an interface seal as explained below. The back shell 20 is then fitted over the elastomeric seal 18 and is secured in place by the lock posts 38 which snap lock and engage the outer surface of the back wall 70 when pushed through the holes 74.

When the back shell 20 is secured in place, the annular wall 69 thereof compresses the longitudinal ribs 66 of the elastomeric seal 18 to stabilize the elastomeric seal 18 in the transverse or radial direction. The back wall 70 of the back shell 20 also compresses the circumferential rib 67 to bias the back wall 64 of the elastomeric seal 18 against the rearward end 30 of the connector body 12 to stabilize the elastomeric seal 18 in the longitudinal direction.

When the clam shells 84, 86 are in the open position as shown in FIG. 7, the terminals 14 can be plugged into the connector body 12 through the guide holes 72 in the exposed back wall 70 of the back shell 20. The terminals 14 fit freely through the guide holes 72 which guide the terminals 14 into the undersize apertures 68 in the back wall 64 of the elastomeric seal 18. As the terminals 14 are plugged in through the undersize apertures 68 and pass into the cavities 26 of the connector body 12, the elastomeric seal 18 is firmly held in place through compression of the longitudinal and circumferential ribs 66, 67 by the annular and back walls 69, 70 of the back shell 20.

When the front of the terminals 14 reach the channel 40 of the terminal cavity 26, the terminal 14 has its land 57 cammed upwardly by the ramp 45. At the same time, the adjacent flexible arm 50 is cammed outwardly from its normal position, as shown in FIGS. 3, 5 and 6, by the same land 57 engaging the ramp 52 of the arm 50. This camming action takes place until the land 57 moves past the shoulders 46, 53 on the ramps 45, 52 respectively. When this occurs, the deflected arm 50 will move from its deflected position, due to its inherent self biasing forces and move inwardly to cause the ramp 52 to move into the recess 48 and cause the terminal 14 to be snapped downwardly against the inner side wall section 40*a* of the channel. This movement of the arm 50 when the land 57 moves past the ramps 52, 45, is rapid and causes an audible click sound to take place. This apprises the operator that the terminal 14 has been inserted far enough into the connector body 12 to be properly connected thereto. This terminal insertion is repeated until all of the terminals 14 have been connected in this fashion. The terminals 14 are prevented from being pulled to the right outwardly of the connector body 12 as a result of the engagement between the land 57 and the shoulders 46, 53. The terminals 14 should all be lightly pulled rearwardly, i.e., toward the right, to seat against the shoulders 46, 53.

When all the terminals 14 are inserted into their respective terminal cavities 26, the cap 22 is mounted to and retained on the nose portion 32 of the connector body 12, as shown in FIG. 1. If all of the terminals 14 are properly seated, the end cap 22 will slide freely thereon and with its rearward portion 130 sliding over the forward portions 50*b* of the deflectable arms 50. This prevents the flexible arms 50 from being flexed radially outwardly and also positions the terminals 14 for reception of the mating pin terminals of the mating electrical connector (not shown).

It should be noted, however, that if one or more of the terminals 14 has not been properly inserted all the way into the connector body 12, the end cap 22 cannot be assembled to the connector body 12. As shown in FIG. 7, if the terminal 14 has not been fully inserted, the flexible arm 50 associated with that terminal 14 will be flexed outwardly. In this flexed outwardly position, the end cap 22 will abut the flexible arm 50 and be prevented from being fully seated onto the connector body 12. The assembler would then have to properly seat that terminal 14. Additionally, if the end cap 22 is forced onto the connector body 12, the arm 50 will pop and slide over the top of the end cap 22 and thus, provide a visual indication that something is wrong and that one of the terminals 14 has not been properly seated in its terminal cavity 26. This provides insurance that the terminals 14 will all be properly seated and thus the end cap 22 provides a terminal position assurance. The end cap 22 also prevents the terminal and the conductor wires from being pushed to the left, as viewed in FIG. 5, when the end cap 22 is connected to the electrical connector body 12.

Thus, it should be noted that the flexible arm 50 provides multiple purposes or advantages. One, they provide an audible click to enable the assembler to know that the terminal 14 has been properly inserted into the electrical connector body 12. They also prevent the end cap 22 from being placed over the forward end 32 of the connector body 12 to retain the terminals in place or against movement to the left, should any of the terminals not be properly seated. Thus, the assembler can be assured that everything has been properly assembled.

After the end cap has been placed on the forward end 32 of the connector body 12, the conductor wires 16 are then bent so as to be routed through the opening 87 in the lower clam shell 86 and then the upper clam shell 84 is then closed and solidly retained in the closed position by the cooperating slotted ledges 102 and the headed lock pins 106. As noted before, the provision of routing the wires sideways through the end bell 83 defined by the clam shells 84, 86 provides for a strain relief should a pulling load be placed on the bundle of wires.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

The embodiments of the invention in which an exclusive property or privilege is claimed are defined as follows:

1. An electrical connector assembly comprising a connector body molded from an electrically insulating material and having a plurality of terminal cavities extending axially through the connector body from a forward contact end to a rearward conductor end, said terminal cavities along a rearward portion of said connector body being defined by side walls surrounding said cavities, said terminal cavities along a forward portion of said connector having rigid inner and side walls defining channels having open outer sides, a first ramp terminating in a transversely extending first lock shoulder and being integral with each of said inner walls of said forward portion of said connector body defining said cavities at a location spaced axially rearwardly of said forward contact end, a plurality of metal cylindrically shaped terminals which are attached to insulated electrical conductors and which are disposed in the respective terminal cavities with the insulated electrical conductors extending out of the rearward conductor end of the connector body, said terminals including radially outwardly extending lands which ride over said first ramps and lock behind said first shoulders of said ramps when positioned within said terminal cavities, and means overlying part of said forward portion of said connector body for retaining said terminals against said inner walls of their respective cavities, and an end cap for receiving said forward portion and connected to said connector body to retain the terminals in position and prevent forward axial movement thereof, the improvement being that said means overlying part of said forward portion of said connector body comprises a plurality of individual, cantilevered, deflectable arms integral with the rearward portion, each of said deflectable arms lying over one of said channels and defining an outer wall for one of said cavities along said forward portion of said connector body, said arms each having a second ramp terminating in a radially extending second shoulder directly opposite said first ramp integral with said associated inner wall of said forward portion of said connector body, said deflectable arms being self biased toward a normal position in which said second shoulders are disposed behind said lands of said terminals, said arms being deflectable radially outwardly of their normal position by said lands of said terminals when the latter are being connected to the connector body by inserting the same from the rearward conductor end toward the forward contact end of the connector body until the lands on the terminals pass by said second ramps whereupon said arms due to their self-biasing forces snap inwardly with an audible click to apprise an assembler that the terminals have been inserted far enough to lock behind said first and second shoulders.

2. An electrical connector assembly comprising a connector body molded from an electrically insulating material and having a plurality of terminal cavities extending axially through the connector body from a forward contact end to a rearward conductor end, said terminal cavities along a rearward portion of said connector body being defined by side walls surrounding said cavities, said terminal cavities along a forward portion of said connector being defined by rigid inner and side walls and having open outer sides, a first ramp terminating in a transversely extending first lock shoulder and being integral with each of said inner walls of said forward portion of said connector body at a location spaced axially rearwardly of said forward contact end, a plurality of metal cylindrically shaped terminals which are attached to insulated electrical conductors and which are disposed in the respective terminal cavities with the insulated electrical conductors extending out of the rearward conductor end of the connector body, said terminals including radially outwardly extending lands which ride over said first ramps and lock behind said first shoulders of said ramps when positioned within said terminal cavities, and means overlying part of said forward portion of said connector body for retaining said terminals against said inner walls of their respective cavities, and an end cap for receiving said forward portion and connected to said connector body to retain the terminals in position and prevent forward axial movement thereof, the improvement being that said means overlying part of said forward portion of said connector body comprises a plurality of individual, axially extending, cantilevered, deflectable arms integral with the rearward portion, each of said deflectable arms lying over one of said outer open sides and defining an outer wall for one of said cavities along said forward portion of said connector body, said arms each having a second ramp terminating in a radially extending second shoulder directly opposite said first ramp integral with said associated inner wall of said forward portion of said connector body, said deflectable arms being self biased toward a normal position in which said second shoulders are disposed behind and engageable with said lands of said terminals, said arms being deflectable radially outwardly of their normal position by said lands of said terminals when the latter are being connected to the connector body by inserting the same from the rearward conductor end toward the forward contact end of the connector body until the lands on the terminals pass by said second ramps whereupon said arms due to their self-biasing forces snap inwardly with an audible click to apprise an assembler that the terminals have been inserted far enough to lock behind said first and second shoulders, said end cap engaging any of said fingers at its free end if such finger is in a deflected position by an improperly seated terminal to provide an indication to the assembler that such terminal has not been properly seated.

3. An electrical connector assembly, as defined in claim 2, and wherein said connector body is mounted to a surrounding back shell having a pair of pivotal clam shells movable between an open position to enable said terminals and conductors to be inserted into said connector body and a closed position, said clam shells of said back shell defining a side opening through which the conductors after being bent extend to provide strain relief for said conductors should a rearward pulling force being exerted on said conductors.

* * * * *